US009759075B2

(12) United States Patent
Bluck et al.

(10) Patent No.: US 9,759,075 B2
(45) Date of Patent: Sep. 12, 2017

(54) TURBOMACHINE ASSEMBLY ALLEVIATING STRESSES AT TURBINE DISCS

(71) Applicant: Siemens Aktiengesellschaft, Munich (DE)

(72) Inventors: Richard Bluck, Welton (GB); Martin Hughes, Leicester (GB)

(73) Assignee: Siemens Aktiengesellschaft, Munich (DE)

( * ) Notice: Subject to any disclaimer, the term of this patent is extended or adjusted under 35 U.S.C. 154(b) by 322 days.

(21) Appl. No.: 14/382,317

(22) PCT Filed: Nov. 22, 2012

(86) PCT No.: PCT/EP2012/073354
§ 371 (c)(1),
(2) Date: Aug. 31, 2014

(87) PCT Pub. No.: WO2013/135319
PCT Pub. Date: Sep. 19, 2013

(65) Prior Publication Data

US 2015/0023800 A1 Jan. 22, 2015

(30) Foreign Application Priority Data

Mar. 13, 2012 (EP) ..... 12159202

(51) Int. Cl.
*F01D 5/30* (2006.01)
*F01D 5/18* (2006.01)
*F01D 5/08* (2006.01)

(52) U.S. Cl.
CPC ..... *F01D 5/3007* (2013.01); *F01D 5/081* (2013.01); *F01D 5/18* (2013.01); *F05D 2250/711* (2013.01); *F05D 2250/712* (2013.01)

(58) Field of Classification Search
CPC ..... F01D 5/3007; F01D 5/18; F01D 5/081; F05D 2250/712; F05D 2250/711
(Continued)

(56) References Cited

U.S. PATENT DOCUMENTS 2,317,338 A 4/1943 Rydmark
4,022,545 A * 5/1977 Shank ..... F01D 5/3007 416/135
(Continued)

FOREIGN PATENT DOCUMENTS

CN 101796266 A 8/2010
CN 101892866 A 11/2010
(Continued)

OTHER PUBLICATIONS

RU Office Action dated Sep. 28, 2016, for RU patent application No. 2014136804.

*Primary Examiner* — Marina Tietjen
(74) *Attorney, Agent, or Firm* — Beusse Wolter Sanks & Maire

(57) ABSTRACT

A turbine arrangement is provided, particularly a gas turbine arrangement, having at least one rotor blade and a turbine disc, the rotor blade having a root portion, the turbine disc having at least one slot in which the root portion of the rotor blade is secured. The slot has a plurality of opposite pairs of slot lobes and a plurality of opposite pairs of slot fillets, and a slot bottom of the slot. The slot bottom is arranged to have a first convex surface section. Furthermore the root portion of the rotor blade has a root bottom with a first concave surface section corresponding to the first convex surface section of the slot bottom. Additionally, the first convex surface section is pierced by an outlet of a cooling duct through the turbine disc.

21 Claims, 3 Drawing Sheets

(58) Field of Classification Search
USPC ..... 416/95, 97 R, 219 R; 415/115–116
See application file for complete search history.

(56) References Cited

U.S. PATENT DOCUMENTS

| | | | | |
|---|---|---|---|---|
| 4,344,738 | A | 8/1982 | Breunig | |
| RE33,954 | E * | 6/1992 | Honda | F01D 5/3007 416/196 R |
| 6,019,580 | A | 2/2000 | Borns | |
| 6,283,707 | B1 * | 9/2001 | Chin | F01D 5/16 416/248 |
| 6,565,318 | B1 | 5/2003 | Tiemann | |
| 6,981,845 | B2 | 1/2006 | Balland et al. | |
| 7,578,656 | B2 | 8/2009 | England | |
| 2005/0254952 | A1 * | 11/2005 | Stone | F01D 5/021 416/219 R |
| 2008/0080980 | A1 * | 4/2008 | Norris | F01D 5/082 416/97 R |
| 2008/0095632 | A1 | 4/2008 | Phipps | |
| 2008/0101938 | A1 | 5/2008 | Johnson | |
| 2008/0232972 | A1 | 9/2008 | Bouchard | |
| 2010/0014958 | A1 | 1/2010 | Bluck et al. | |
| 2010/0178169 | A1 | 7/2010 | Webb | |
| 2010/0296936 | A1 | 11/2010 | Black | |
| 2011/0085888 | A1 * | 4/2011 | Gouda | F01D 5/081 415/110 |

FOREIGN PATENT DOCUMENTS

| | | | |
|---|---|---|---|
| DE | 950557 | C | 10/1956 |
| DE | 102007051096 | A1 | 4/2008 |
| EP | 1041246 | A1 | 10/2000 |
| EP | 1892375 | A1 | 2/2008 |
| GB | 2095765 | A | 10/1982 |
| GB | 2452515 | A | 3/2009 |
| JP | S54137602 | A | 10/1979 |
| JP | S5698502 | A | 8/1981 |
| JP | S58167807 | A | 10/1983 |
| JP | 2002540347 | A | 11/2002 |
| RU | 2325537 | C2 | 5/2008 |

* cited by examiner

TURBOMACHINE ASSEMBLY ALLEVIATING STRESSES AT TURBINE DISCS

CROSS REFERENCE TO RELATED APPLICATIONS

This application is the US National Stage of International Application No. PCT/EP2012/073354 filed Nov. 22, 2012, and claims the benefit thereof. The International Application claims the benefit of European Application No. EP12159202 filed Mar. 13, 2012. All of the applications are incorporated by reference herein in their entirety.

FIELD OF THE INVENTION

The present invention relates generally to a turbomachine assembly, particularly an assembly of a rotor blade and a rotating turbine disc, preferably in a hot turbine section of a gas turbine engine.

BACKGROUND OF THE INVENTION

A turbine section of a gas turbine typically has a plurality of rows of stationary vanes and rotary blades. The blades of one row are usually identical to each other and include an aerofoil portion, a platform portion, and a root portion. Some blade rows may additionally include a shroud portion preventing the hot gases escaping over the blade tip. In reference to an axis of rotation which may define an axial direction within the gas turbine engine, the root portion is the most radial inward section of the blade, i.e. directed to the axis of rotation. A radial direction may be defined as being perpendicular to the axis of rotation. The root portion is used to mount the blade in a mounting groove or slot provided in a rotor disc. Typically for each rotor blade a corresponding mounting groove is provided. The blades are particularly assembled by axially sliding each root portion into the corresponding groove.

It is known for turbine blades to be fitted to turbine discs by means of cooperating firtree profiles. Such fixing methods provide accurate location of the blade with respect to the disc. Firtree profiles are sufficiently strong to withstand the radially outward—centrifugal—forces imposed on the blade during rotation of the disc and its attached blades in operation of the turbine engine in which it is installed. In operation, flanks of the firtree profiles of the blades which face away—in a slanted manner—from the axis of rotation and which are in contact with opposite firtree profiles of the grooves, support the blades against radially outward movement, and can be regarded as loaded flanks. The oppositely facing flanks of the profiles can be regarded as unloaded flanks, since they do not support any significant radial forces in operation.

The conventional shape of a turbine blade firtree root is defined using straight lines and circular arcs only, when looked at in a sectional view of the blade root, the sectional view is defined by a plane perpendicular to the rotor axis of the turbine. Such a shape is optimised against a number of geometric and mechanical constraints.

The flanks of the profiles are interconnected by transition regions which are alternately convex surfaces, which are usually but not always arcuate and are referred to as fillets or necks, and concave surfaces, which are usually but not always arcuate and are known as corners or lobes or teeth or lugs. The fillets are typically regions of high stress concentration.

A root may be substantially mirror-symmetrical. The root comprise a pair of symmetrical uppermost necks or fillets which extends downwardly from a lower surface of a platform and form a recess in circumferential direction, a pair of uppermost lugs or lobes which extend downwardly from the uppermost necks and form a projection in circumferential direction. A plurality of symmetrical pairs of necks and lobes may follow downwardly in alternating order. The root portion will end via a pair of symmetrical lowermost necks followed by a pair of symmetrical lowermost lobes. Surfaces of the pair of lowermost lobes will converge and will be joined at a most downward location via an arcuate or flat surface, the root bottom.

Rotor blades in a turbine section are affected by hot working fluid in a main gas path. This may require cooling. Rotating part may be difficult to cool. In order to lengthen the life of the blade, the blade is often cooled by passing a cooling fluid through cooling ducts provided inside the blade aerofoil. To supply cooling fluid to the ducts or hollow interior of the blade, cooling fluid may for example be provided via passages within in the root of the blade.

A common means of supplying the cooling air to the rotor blades is via holes at a rim of the turbine disc which transmit the cooling air from a separate internal cavity and into passages provided at the base of the blade roots.

In more detail, in order to supply cooling fluid to an inlet 28 within a bottom of the blade root 1 of a rotor blade 2, as illustrated in FIG. 1A and in a cross sectional view in FIG. 1B, a duct—see reference sign 42 in FIG. 1C—may be provided in the turbine disc 5, which carries cooling fluid from outside the disc to the disc slot 40, from where it flows into the inlet 28. An example of a disc according to this arrangement is given in FIG. 1C. This example is taken from U.S. Pat. No. 4,344,738 to assignee United Technologies Corp. and shows the fir-tree shaped disc slot 40, the duct 42 in the disc, an outlet 44 at the radially outer end of the duct 42, and an inlet 46 in an end-face of the disc. In operation the cooling fluid—typically air taken from a compressor section of the turbine engine—enters the inlet 46, passes through the duct 42 and leaves at the outlet 44, where it finally enters a cooling passage in the corresponding rotor blade, which is inserted in the slot.

It is recognised that a high stress may exist within the disc at the outlet holes during operation. It is a goal to minimize the stress concentration in the area of the outlet, particularly induced by hoop stresses.

Patent application EP 1 892 375 A1 already provides a solution by eliminating the acute corner produced by the radial intersection of the cooling hole and the disc slot bottom by introducing a cut-out feature in the disc slot bottom.

SUMMARY OF THE INVENTION

It is an object of the invention to provide an alternative or improved design reducing stress concentration in the disc at the bottom of a disc slot. Preferably, it is also an object of the invention to reduce the stress concentration near an outlet of a cooling hole leading to a bottom of a disc slot.

This objective is achieved by the independent claims. The dependent claims describe advantageous developments and modifications of the invention.

In accordance with aspects of the invention there is provided a turbine arrangement, particularly a gas turbine arrangement within a turbine section of a gas turbine engine, comprising at least one rotor blade and a turbine disc. The rotor blade comprises a root portion. The turbine disc comprises at least one slot in which the root portion of the rotor blade is secured, i.e. the rotor blade is inserted or slid into the slot such that it will be held in position in all modes of operation or even when the gas turbine engine stands still. The slot comprises a plurality of opposite pairs of slot lobes, a plurality of opposite pairs of slot fillets. This allows securing the rotor blade which preferably has a corresponding design of lobes and fillets. The slot further comprises a slot bottom of the slot, wherein the slot bottom comprises a first convex surface section. Additionally the root portion of the rotor blade comprises a root bottom comprising a first concave surface section corresponding to the first convex surface section of the slot bottom. Furthermore, the first convex surface section is pierced by an outlet of a cooling duct through the turbine disc.

In other words, a root lobe of the rotor blade, which according to the prior art may by substantially cylindrical or cylindrical with a flat section at the bottom, is modified to have a concave region within its root lobe. According to aspects of the invention the slot bottom follows this shape such that it forms the convex section as a complementary to the concave region of the root lobe.

As a consequence, the first concave surface section is substantially a parallel translation of the first convex surface section.

The form of the slot bottom, i.e. the base of the disc slot, is thus profiled in order to minimise stresses. Particularly, in combination with the cooling duct as a cooling passage ending in the cooling outlet in the slot bottom, this profile allows minimising encroachment of hoop stresses around the periphery of the cooling outlet or hole and thus minimise the peak stress. This works by effectively undercutting the form so as to disassociate the position of peak stress around the cooling hole from the main hoop stress field.

Typically, as one turbine disc provides a plurality of slots for connecting a plurality of rotor blades, the specific design of the slot bottom may be applied to all or at least to a number of slots of the turbine disc.

Even though only the root portion was introduced for the rotor blade of this invention, obviously the blade also comprises a platform and an aerofoil and possibly a shroud.

In general embodiments of this invention may be applied to different types of disc slots and rotor blades. Preferably the rotor blade and the disc slot follow a firtree design such that the rotor disc for mounting turbine blades comprises a plurality of disc slots, each of the plurality of disc slots further comprises a plurality of opposite pairs of slot lobes, each of the pair of slot lobes being arranged substantially mirror-symmetrical and each slot lobe comprising a convex slot lobe surface section. Furthermore each disc slot comprises a plurality of opposite pairs of slot fillets, each of the pair of slot fillets being arranged substantially mirror-symmetrical and each slot fillet comprising a concave slot fillet surface section. The slot lobes and the slot fillets are arranged in an alternating order with slot flanks in between. The bottom slot lobe then follows the design as explained above that a convex section is present at its bottom end. Besides that convex section the bottom slot lobe may follow substantially a concave, substantially cylindrical form.

The form of a blade root in form of a firtree may alternatively also be called dovetail design.

Corresponding to this slot design, the blade may be defined comprising a blade root comprising a plurality of opposite pairs of lobes, a plurality of opposite pairs of fillets, a bottom of the blade root, and a plurality of flanks, wherein the lobes and the fillets are arranged in an alternating order and each of the flanks is arranged between one of the lobes and one of the fillets. Each of the pair of lobes is arranged substantially mirror-symmetrical and each lobe comprises a convex lobe surface section. Each of the pair of fillets is arranged substantially mirror-symmetrical and each fillet comprises a concave fillet surface section.

The bottom blade root lobe then follows the design as explained above that a concave section is present at its bottom end. Besides that concave section the bottom root lobe may follow substantially a convex, substantially cylindrical form.

For clarification, when a slot lobe is defined as cylindrical in this document, that means that the cut out is cylindrical so that the surface of that cylindrical section is an inner surface of a cylinder (or a pipe). Different to that, a cylindrical root lobe means that the surface of the lobe follows the form of an outer surface of a cylinder.

With the term "opposite" pair of lobes two lobes are meant that are mirror symmetrical to each other and define surfaces which face in diametric directions. The same applies to opposite pair of fillets, flanks, etc. accordingly.

In a preferred embodiment, the first convex surface section of the slot bottom of the disc slot merges into a first and a second concave surface section, each of the first and second concave surface sections being adjacent to the first convex surface section and further forming a surface of a lower slot fillet of the plurality of opposite pairs of slot fillets.

Preferably the blade root follows this form completely, thus that first concave surface section of the blade root bottom merges into a first and a second convex surface, each of the first and second convex surface sections being adjacent to the first concave surface section and further forming a surface of a lower blade root lobe of a plurality of opposite pairs of blade root lobes.

In another embodiment, the first and/or the second concave surface section of the slot merges into a first planar surface section defining a mating or surface with a corresponding second planar surface section of the rotor blade, the first planar surface section and the second planar surface section being in physical or bearing contact during operation of the turbine arrangement.

As previously said, according to aspects of the invention the first convex surface section of the slot is pierced by an outlet of a cooling duct through the turbine disc. In one embodiment, the outlet will be limited to be only a cut-out in the first convex surface section.

Alternatively the outlet will have an expanse that it has a cut-out in the first convex, the first concave, and the second concave surface section. In other words, the outlet of the cooling duct additionally pierces the first and the second concave surface sections. The outlet spreads over the first convex surface section and the first and the second concave surface sections. A rim of the outlet extends substantially up to the two slot bottom regions with the most indention into the turbine disc, which are located in the first and second concave surface sections of the slot bottom.

An inlet within the blade root may correspond to the expanse of the mentioned outlet so that a rim of the inlet extends substantially up to the two blade root bottom regions with the most radial protuberance from the blade root, which are located in the first and second convex surface sections of the blade root.

In an embodiment, a rim formed in the slot bottom by the outlet of the cooling duct having substantially a saddle-like shape. The saddle-like shape of the rim may be particularly formed with a circular, or elliptical, or oval perimeter line when seen from the top of the slot, i.e. resulting from a projection in direction of the aerofoil portion of the blade.

In yet another embodiment, the cooling duct provides a passage for guiding cooling fluid—like air, particularly taken from a compressor—through the turbine disc from a side face of the turbine disc—e.g. from an upstream or a downstream side face—or from an annular cavity within the turbine disc or from an annular cavity formed by a side face of the turbine disc and an adjacent component. The passage may be straight or may follow a curve. A direction of the passage may have only an axial and a radial vector component, but no circumferential vector component.

In a further embodiment and as previously indicated, the blade root comprises at least one inlet opposite to the outlet of the cooling duct of the turbine disc (5) such that cooling fluid can be guided from the outlet via the inlet to a hollow interior of the rotor blade during operation of the turbine arrangement. The inlet may be an extension or prolongation of the cooling duct within the turbine disc so that cooling fluid can be guided with obstruction or turbulence. The inlet and the outlet will be in fluid communication.

In one embodiment, there will be only one inlet into the blade root. Alternatively, as illustrated in FIG. 4, the root portion 110 of the rotor blade 112 comprises a cavity 114 in the root bottom 116, a bottom of the cavity defining at least a first one 26A and a second one 26B of the at least one inlet. The cooling fluid provided by the outlet may be distributed via the cavity to the plurality of inlets.

According to aspects of the invention, the previously explained turbine arrangements are preferably located in a gas turbine engine, particularly in a turbine section of such a gas turbine engine.

Nevertheless, the basic idea may also be applied to other turbomachinery. It may be applied for examples to steam turbines or other rotating machines, like motors or compressors. Besides, the inventive turbine arrangement can also be used for mounting non-rotating stator vanes in case a similar mounting design is used.

It has to be noted that embodiments of the invention have been described with reference to different subject matters. In particular, some embodiments have been described with reference to apparatus type claims whereas other embodiments may have been described with reference to methods. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

The aspects defined above and further aspects of the present invention are apparent from the examples of embodiment to be described hereinafter and are explained with reference to the examples of embodiment

BRIEF DESCRIPTION OF THE DRAWINGS

Embodiments of the invention will now be described, by way of example only, with reference to the accompanying drawings, of which.

The illustration in the drawing is schematical. It is noted that for similar or identical elements in different figures, the same reference signs will be used.

Some of the features and especially the advantages will be explained for an assembled gas turbine, but obviously the features can be applied also to the single components of the gas turbine but may show the advantages only once assembled and during operation. But when explained by means of a gas turbine during operation none of the details should be limited to a gas turbine while in operation. In general embodiments of the invention may be applied to other types of machines that provide a rotational movement about an axis of rotation and at which rotating parts need to be connected to a carrier element this executing a rotational movement about the axis, so that centrifugal forces effect the rotating parts. Particularly this technology may be applied to gas turbines engines or steam turbines engines. In regards of gas turbine engines, embodiment of the invention may be applied to rotor blades within a turbine section and/or within a compressor section.

DETAILED DESCRIPTION OF THE INVENTION

Figure 1A:
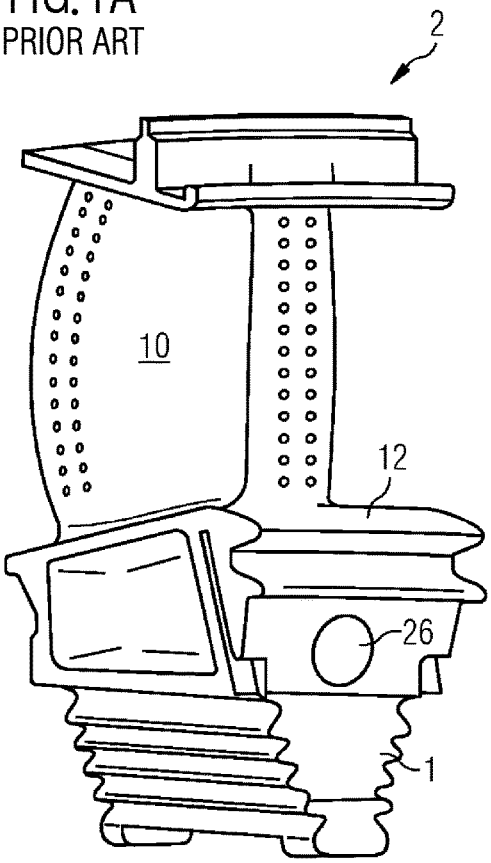
FIG. 1A PRIOR ART
FIG. 1A shows schematically a prior art rotor blade in perspective.
Figure 1B:
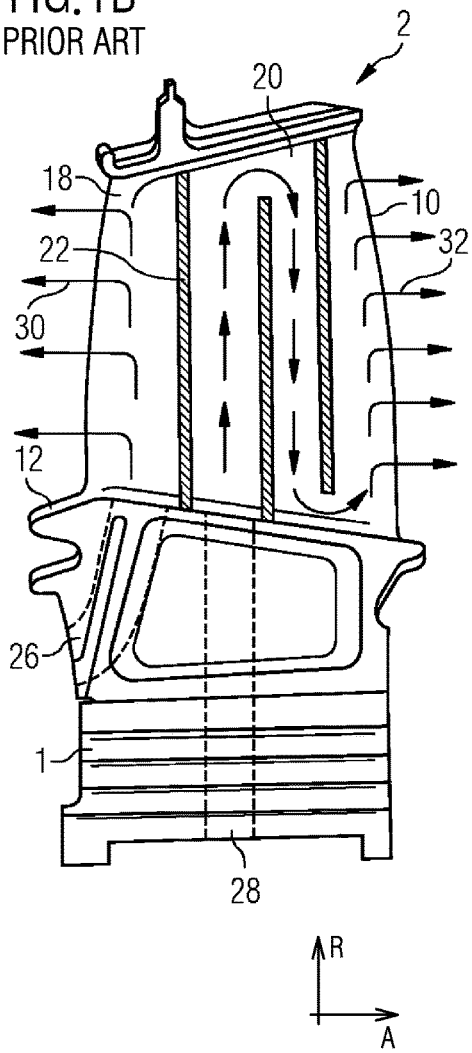
FIG. 1B PRIOR ART
FIG. 1B shows the same blade in cross-section.
Figure 4:
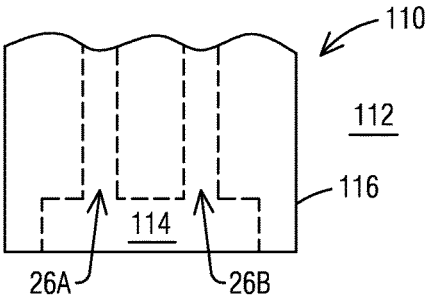
FIG. 4 shows a side view of an alternative turbine arrangement wherein a cavity in the blade root bottom defines first and second cooling fluid inlets.
Figure 1C:
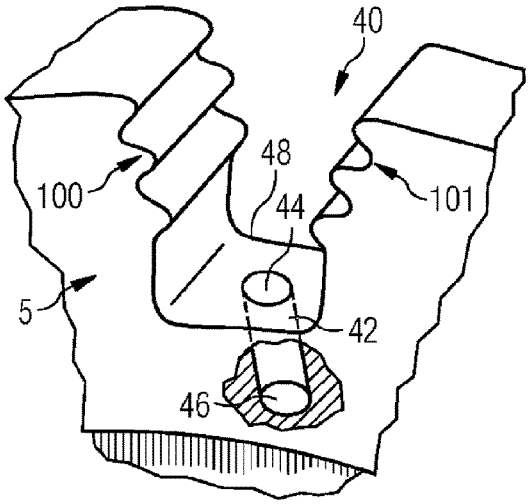
FIG. 1C PRIOR ART
FIG. 1C shows a section of a prior art rotor disc.
Figure 2:
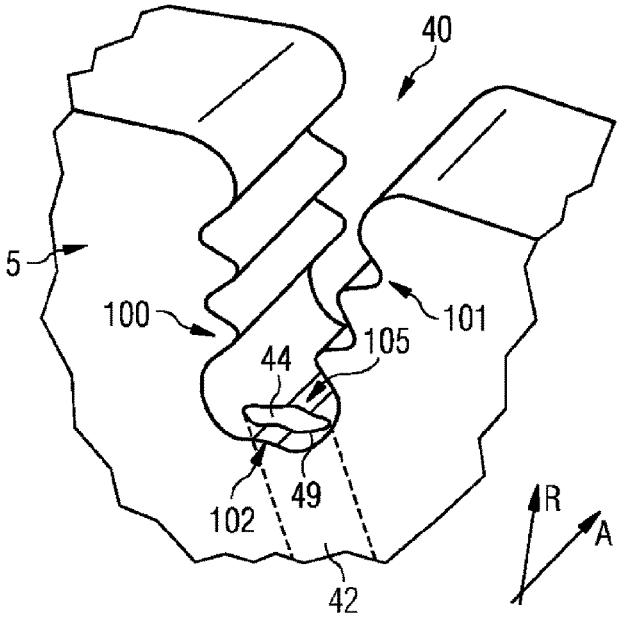
FIG. 2: illustrates in a perspective way a section of a rotor disc.
Figure 3:
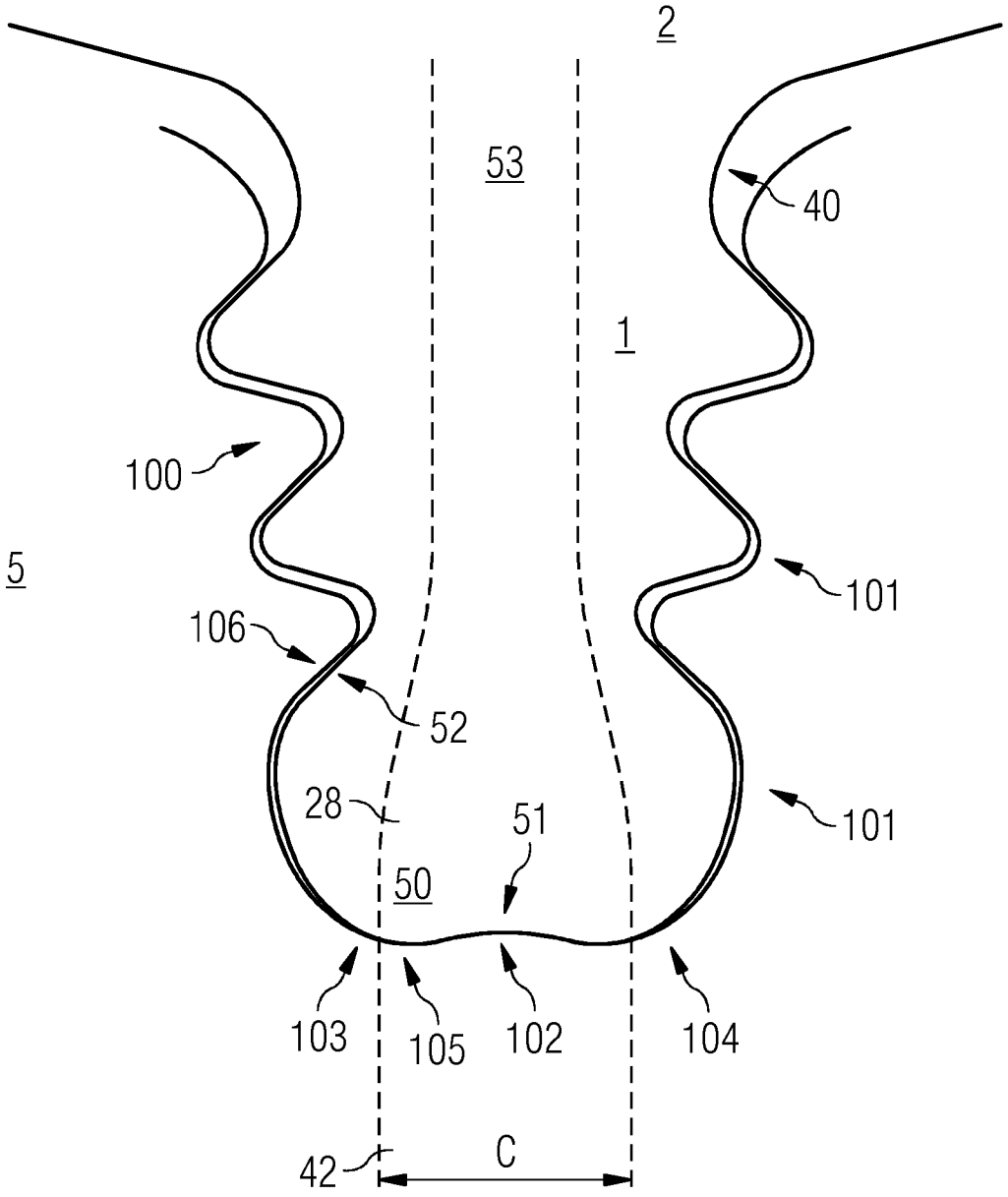
FIG. 3: shows in a side view a turbine arrangement comprising a section of a rotor disc and a blade root of a rotor blade.

FIGS. 1A and 1B show a blade design that is known from the prior art and that will slightly be modified according to aspects of the invention, which is then later shown in FIG. 3. FIG. 1C shows a prior art rotor disc design, which is updated according to aspects of the invention as shown in FIGS. 2 and 3.

FIG. 1A shows a rotor blade 2 of a gas turbine engine in a perspective view. FIG. 1B shows the same rotor blade 2 in a cross sectional view, the cross section being located in a plane defined by an axial direction A—parallel to an axis of rotation of the engine—and a radial direction R—perpendicular to the axis of rotation. The rotor blade 2 is made up of an aerofoil section 10, a platform 12, and a blade root portion 1. The blade root portion 1 engages with a correspondingly shaped slot in a rotor disc. The blade root portion 1 is configured as "fir tree" shape, this being often preferred because of its excellent resistance against the centrifugal forces exerted upon the rotor blade when the rotor disc is rotated at high speed. In use, the rotor blade 2 is subjected to considerable stresses, due to the very high temperature of the working fluid flowing over the surface of the aerofoil section 10. In order to lengthen the life of the blade, the blade is often cooled by passing a cooling fluid through cooling ducts provided inside the blade. FIG. 1B shows two separate such ducts 18 and 20, which are separated by a partition piece 22. Duct 18 is defined by the inside walls of the aerofoil section and a partition piece 22. Duct 20 covers the remainder of the interior of the aerofoil section 10 and defines a hollow interior of the rotor blade 2.

In order to supply cooling fluid to the ducts 18 and 20, in the example shown two fluid inlets 26, 28 of the rotor blade 2 are provided. Cooling-fluid flow is then from outside the blade 2 through the inlets 26, 28 and into the ducts 18, 20, as shown in FIG. 1B. The fluid leaves the blade through holes provided in the leading and trailing edges of the aerofoil section, as shown by the arrows 30, 32, respectively.

In order to supply cooling fluid to the inlet 28 in FIG. 1B, a cooling duct is provided in the rotor disc, which carries cooling fluid from outside the disc to the slot, from where it flows into the inlet 28. An example of such an arrangement is given in FIG. 1C. This example shows the fir-tree shaped disc slot 40, the cooling duct 42 in the rotor disc 5, an outlet 44 at the radially outer end of the duct 42, and an inlet 46 for the cooling duct in an end-face of the rotor disc 5. In FIG. 1C the rotor blade is not inserted in the disc slot 40. Also shown is the bottom portion 48 of the slot.

In operation—with installed rotor blades—cooling fluid passes through a system of cavities and ducts up to inlet 46 of the cooling duct 42 arranged within the rotor disc 5. The fluid then enters the inlet 46, passes through the cooling duct 42 and leaves the rotor disc 5 at the outlet 44, where it finally enters a cooling passage of the rotor blade 2—as indicated by inlet 28 in FIG. 1B.

In FIG. 2 a perspective view of a segment of a rotor disc 5 is shown, which shows an embodiment of the inventive idea. As before in FIG. 1C, the rotor blade 2 is not shown in this figure. Merely the empty slot 40 is shown, that will later be used to slide in a blade root—root portion 1—of a rotor blade 2. Obviously the rotor disc 5 provides a plurality of these slots 40, but only one is shown for the following explanation. The figure shows the section of the rotor disc 5 such that a part of an axial side face of the rotor disc 5 is shown and furthermore a part of a substantially cylindrical surface of the rotor disc 5 expanding in the axial direction A and a circumferential direction—the latter being perpendicular to the axial direction A and the radial direction R at a specific point—, which is cut by a slots 40.

In the figure within the turbine disc 5 one slot 40 is present in which a root portion of a corresponding rotor blade can be secured. The slot 40 comprises a plurality of opposite pairs of slot lobes 100 projecting into the slot 40 and a plurality of opposite pairs of slot fillets 101. "Opposite" means that the slot 40 is substantially mirror symmetrical and that the slot lobes 100 and the slot fillets 101 come in symmetrical pairs. The slot 40 further comprises a slot bottom 105 defining that radial end of the slot 40 that is closest to the axis of rotation or which has the longest distance to the hot gas path or the blade aerofoil. The slot bottom 105 comprises a first convex surface section 102. This means that there is a radial elevation in the slot bottom 105. Not shown in this figure but later in FIG. 3, the slot bottom 105 is arranged such that its first convex surface section 102 corresponds to a first concave surface section (reference sign 51 in FIG. 3) of a root portion or a rotor blade to be inserted in the slot 40.

In FIG. 2 furthermore a cooling duct 42 is indicated by dotted lines and an outlet 44 of the cooling duct that is present in the slot bottom 105. In a first embodiment, as shown in FIG. 2, the outlet 44 will be closer to one of the side faces of the rotor disc 5. In an alternative embodiment—not shown—the outlet 44 will have the same axial distance to both side faces of the rotor disc 5.

The cooling duct 42 may be cylindrical with a circular cross section or with an elliptical or oval cross section. As the cooling duct 42 pierces or penetrates the slot bottom 105 a rim 49 is present on the surface of the slot bottom 105 defining the outlet 44 of the cooling duct 42 (as an intersection of the cooling duct 42 and the surface of the slot bottom 105). The rim 49 will have a saddle-like shape due to the first convex surface section 102.

Preferably the outlet 44 stretches in a direction perpendicular to the axial and radial direction—in circumferential direction—such that the cooling duct 42 pierces the first convex surface section 102 and two concave surface sections—reference signs 103 and 104 in FIG. 3—which are adjacent to the convex surface section 102 in both circumferential directions.

This design is specifically advantageous as—during operation of the gas turbine engine—the base of the disc slot form is profiled in order to minimise the encroachment of hoop stresses around the periphery of the cooling hole and thus minimise the peak stress. This is realised by effectively undercutting the form so as to disassociate the position of peak stress around the cooling hole from the main hoop stress field.

FIG. 3 shows a side view from axial direction of the turbine disc 5 as shown in FIG. 2. Furthermore FIG. 3 depicts a configuration in which rotor blade 2 is already inserted in the disc slot 40, as it would be during operation of the gas turbine engine. The reference signs are identical to the previous figures so that not all parts need to be discussed in full detail. All previously said still applies for the configuration of FIG. 3.

According to FIG. 3, a rotor blade 2 with its root section 1 is inserted into a slot 40 of the disc 5. The disc 5 provides a cooling duct 42 that is directed and ends at the slot bottom 105 of the slot 40.

The root portion 1 of the rotor blade 2 corresponds to the shape of the slot 40 such that root fillets match slot lobes 100 and root lobes match slot fillets 101. In between a slot lobe 100 and a slot fillet 101 there is a substantially flat surface, a first planar surface section 106 which is provided as a bearing surface for a corresponding second planar surface section 52 or flank of the blade root 1, both surfaces being in physical and bearing contact during operation of the turbine arrangement.

Within the blade root 1, a blade root cooling duct 53 is indicated by dotted lines. An inlet of the blade root cooling duct 53 is aligned with the cooling duct 42 through the rotor disc 5 so that the cooling fluid will be guided into the interior of the rotor blade 2.

In FIG. 3 the specific shape of the lowest root lobe or the lowest slot fillet become apparent. The lowest root lobe is substantially cylindrical formed by a first concave surface section 103 following a first planar surface section 106 and a second concave surface section 104 following a further one of a first planar surface section 106. The first concave surface section 103 and the second concave surface section 104 do not meet at the root bottom 50. The first concave surface section 103 merges into a first convex surface section 102 and the second concave surface section 104 also merges into the first convex surface section 102 from a second side. The first convex surface section 102 will be located right in the center of the lowest lobe, i.e. at the axis of symmetry of the slot 40.

Compared to its circumferential stretch the first convex surface section 102 has a mirror elevation in radial direction. The circumferential stretch may be in a ratio of 10:1 compared to the radial elevation.

Within the turbine disc 5, the cooling duct 42 is present. Its circumferential stretch is indicated by a double arrow and fully extends the circumferential width of the first convex surface section 102. Preferably, and as indicated in the figure, the circumferential stretch is extending into the region of the first concave surface section 103 and also is extending into the region of the second concave surface section 104. Particularly it will extend just up to an area of most radial depth of the slot 40 within the first concave surface section 103 and up to an area of most radial depth of the slot 40 within the second concave surface section 104.

Alternatively—as it is shown in the figure—the first convex surface section 102 even extends past the area of most radial depth of the slot 40 within the first concave surface section 103 and extends past the area of most radial depth of the slot 40 within the second concave surface section 104. In this configuration the expanse of the first convex surface section 102 is substantially the complete slot bottom 105 in circumferential direction (wherein the circumferential direction corresponds to a horizontal direction in FIG. 3).

The arrangement, as previously introduced for the disc slot 40 affects also the configuration of the blade root 1, such as the blade root bottom 50 follows the shape of the disc slot bottom 105. That means that starting on one circumferential side, a lowest flank provides a second planar surface section 52, merging into a convex surface section (opposite to the first concave surface section 103), which again merges into first concave surface section 51 of the blade root 1. Further continuing, this first concave surface section 51 then merges into a further convex surface section (opposite to the second concave surface section 104) and then merges into a further second planar surface section located on the opposite circumferential side.

Corresponding to the cooling duct 42 and its outlet 44 (which is not indicated explicitly in FIG. 3), the blade root cooling duct 53 has the same size inlet 28 (which is not indicated explicitly in FIG. 3) as the outlet 44. The blade root cooling duct 53 may be a straight passage to the aerofoil section. The blade root cooling duct 53 may also narrow its width, as indicated in FIG. 3.

The previously discussed turbine arrangement may particularly be applied to a high power stage of a turbine section within a gas turbine engine.

Embodiments as introduced before may have a substantial benefit in regards of the lifetime of rotor discs. Stresses can be avoided that could result in cracks. Monitoring cycles can be stretched.

It has to be noted that that it may be advantageous if exactly three pairs of lobes and three pairs of fillets may be present on the blade root and in the slot, as shown in FIG. 3. Possibly other configurations may also be possible.

The invention claimed is:

1. A turbine arrangement, comprising at least one rotor blade and a turbine disc, the rotor blade comprising a root portion, the turbine disc comprising at least one slot in which the root portion of the rotor blade is secured, the slot comprising a plurality of opposite pairs of slot lobes, a plurality of opposite pairs of slot fillets, and a slot bottom of the slot, wherein the slot bottom comprises a first convex surface section, wherein the root portion of the rotor blade comprises a root bottom comprising a first concave surface section corresponding to the first convex surface section of the slot bottom, and wherein the first convex surface section is pierced by an outlet of a cooling duct through the turbine disc.

2. The turbine arrangement according to claim 1, wherein the first convex surface section of the slot bottom merges into a first and a second concave surface sections of the slot, each of the first and second concave surface sections of the slot being adjacent to the first convex surface section and further forming a surface of a lower slot fillet of the plurality of opposite pairs of slot fillets.

3. The turbine arrangement according to claim 2, wherein the first and/or the second concave surface sections of the slot merges into a first planar surface section defining a mating surface with a corresponding second planar surface section of the rotor blade, the first planar surface section and the second planar surface section being in physical contact during operation of the turbine arrangement.

4. The turbine arrangement according to claim 2, wherein the outlet of the cooling duct additionally pierces the first and the second concave surface sections of the slot.

5. The turbine arrangement according to claim 1, further comprising a rim formed in the slot bottom by the outlet of the cooling duct having substantially a saddle-like shape.

6. The turbine arrangement according to claim 1, wherein the root portion comprises at least one inlet opposite to the outlet of the cooling duct of the turbine disc such that cooling fluid can be guided from the outlet via the inlet to a hollow interior of the rotor blade during operation of the turbine arrangement.

7. The turbine arrangement according to claim 6, wherein the root portion of the rotor blade comprises a cavity in the root bottom, a bottom of the cavity defining at least a first one and a second one of the at least one inlet.

8. A gas turbine comprising a turbine arrangement, wherein the turbine arrangement is arranged according to claim 1.

9. The turbine arrangement according to claim 1, wherein the cooling duct provides a passage through the turbine disc from a side face of the turbine disc or from an annular cavity within the turbine disc or from an annular cavity formed by a side face of the turbine disc and adjacent components.

10. The turbine arrangement according to claim 1, wherein the turbine arrangement is a gas turbine arrangement.

11. A turbine disc comprising:

at least one slot in which a root portion of a rotor blade can be secured, the slot comprising, a plurality of opposite pairs of slot lobes, a plurality of opposite pairs of slot fillets, and a slot bottom of the slot, wherein the slot bottom comprises a first convex surface section, wherein the first convex surface section is pierced by an outlet of a cooling duct through the turbine disc.

12. The turbine disc of claim 11, wherein the first convex surface section of the slot bottom merges into a first and a second concave surface sections, each of the first and second concave surface sections being adjacent to the first convex surface section and further forming a surface of a lower slot fillet of the plurality of opposite pairs of slot fillets.

13. The turbine disc of claim 12, wherein the first and/or the second concave surface sections of the slot merges into a first planar surface section defining a mating surface with a corresponding second planar surface section of a rotor blade, the first planar surface section configured to be in physical contact with the second planar surface section during operation of a turbine arrangement comprising the turbine disc.

14. The turbine disc of claim 12, wherein the outlet of the cooling duct additionally pierces the first and the second concave surface sections.

15. The turbine disc of claim 11, further comprising a rim formed in the slot bottom by the outlet of the cooling duct having substantially a saddle-like shape.

16. The turbine disc of claim 11, wherein the cooling duct provides a passage through the turbine disc from a side face of the turbine disc or from an annular cavity within the turbine disc or from an annular cavity formed by a side face of the turbine disc and adjacent components.

17. A rotor blade for a turbine, comprising:

at least one rotor blade, the rotor blade comprising a root portion, the root portion of the rotor blade being arranged such that it can be secured to a turbine disc comprising at least one slot in which the root portion of the rotor blade can be secured, the root portion comprising a plurality of opposite pairs of root lobes, a plurality of opposite pairs of root fillets, and a root bottom of the root portion, wherein the root portion of the rotor blade comprises a root bottom comprising a first concave surface section, and wherein the first concave surface section provides an inlet for guiding cooling fluid.

18. The rotor blade for a turbine of claim 17, wherein the root portion comprises at least one inlet opposite to an outlet of a cooling duct of a turbine disc such that cooling fluid can be guided from the outlet via the inlet to a hollow interior of the rotor blade during operation of a turbine arrangement, and wherein the root portion of the rotor blade comprises a cavity in the root bottom, a bottom of the cavity defining at least a first one and a second one of the at least one inlet.

19. The rotor blade for a turbine of claim 17, further comprising:

the first concave surface section merges into a first and a second convex surface section, each of the first and second convex surface sections being adjacent to the first concave surface section and further forming a surface of the root bottom.

20. The rotor blade for a turbine of claim 19, wherein the inlet for guiding cooling fluid pierces the first and second convex surface sections.

21. A rotor blade for a turbine, characterized by a root bottom comprising a concave surface section;

wherein the root bottom is further characterized by first and second convex surface sections on respective opposed sides of the concave surface section;

further characterized by an inlet of a cooling duct of the rotor blade piercing the concave surface section and the first and second convex surface sections; and further characterized by the inlet of the cooling duct extending past an area of most radial depth of the respective first and second convex surface sections.

* * * * *